US008215729B2

(12) United States Patent
Hunnell et al.

(10) Patent No.: US 8,215,729 B2
(45) Date of Patent: Jul. 10, 2012

(54) APPLIANCE CABINET AND METHOD OF ASSEMBLING SAME

(75) Inventors: John M. Hunnell, St. Joseph, MI (US); Jason S. Sabel, Berrien Springs, MI (US); James R. Sawyer, Monticello, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/911,985

(22) Filed: Oct. 26, 2010

(65) Prior Publication Data

US 2011/0248611 A1 Oct. 13, 2011

Related U.S. Application Data

(60) Provisional application No. 61/323,667, filed on Apr. 13, 2010.

(51) Int. Cl.
*A47B 97/00* (2006.01)
*A47B 88/00* (2006.01)
*A47K 1/04* (2006.01)

(52) U.S. Cl. ..... 312/352; 312/228; 312/323

(58) Field of Classification Search ..... 312/228, 312/265.5, 265.6, 257.1, 263, 293.2, 293.3, 312/313–316
See application file for complete search history.

(56) References Cited

U.S. PATENT DOCUMENTS

| | | | | | |
|---|---|---|---|---|---|
| 483,669 | A * | 10/1892 | Ganzlin | 108/8 |
| 2,878,092 | A * | 3/1959 | O'Neal | 312/310 |
| 3,741,405 | A * | 6/1973 | McConnell et al. | 211/192 |
| 3,771,847 | A * | 11/1973 | Aylworth | 312/245 |
| 3,814,491 | A | 6/1974 | Kackley | |
| 4,268,098 | A | 5/1981 | Kretchman et al. | |
| 4,310,193 | A * | 1/1982 | Kolleas | 296/75 |
| 4,516,813 | A * | 5/1985 | Sekerich | 312/323 |
| 5,175,386 | A * | 12/1992 | Kuwahara | 84/179 |
| 5,685,623 | A | 11/1997 | Katz et al. | |
| 5,758,937 | A * | 6/1998 | Lammens et al. | 312/328 |
| 5,927,836 | A | 7/1999 | Herr et al. | |
| 5,931,550 | A * | 8/1999 | Chen | 312/244 |
| 5,971,510 | A | 10/1999 | Lickiss et al. | |
| 6,318,824 | B1 * | 11/2001 | LaGrotta et al. | 312/322 |
| 6,502,431 | B1 | 1/2003 | Yamano et al. | |
| 6,513,196 | B2 * | 2/2003 | Snowden et al. | 16/268 |
| 7,360,323 | B2 | 4/2008 | Lee et al. | |
| 7,621,156 | B2 * | 11/2009 | Kim et al. | 68/23 R |
| 2002/0145368 | A1 * | 10/2002 | Brown | 312/313 |
| 2005/0012439 | A1 * | 1/2005 | Kim et al. | 312/228 |
| 2005/0110374 | A1 | 5/2005 | Hwang et al. | |
| 2005/0138836 | A1 | 6/2005 | Hwang et al. | |
| 2005/0179347 | A1 * | 8/2005 | Kim et al. | 312/228 |

(Continued)

FOREIGN PATENT DOCUMENTS

CN 201221026 Y 4/2009

(Continued)

*Primary Examiner* — David Dunn
*Assistant Examiner* — Ryan A Doyle
(74) *Attorney, Agent, or Firm* — Clifton G. Green; McGarry Bair PC

(57) ABSTRACT

An appliance cabinet, such as a laundry treating appliance cabinet, having a chassis and a cover removably mounted to the chassis, and a labyrinth coupler connecting the cover and the chassis, wherein the coupler is physically configured to define a path requiring a specific sequence of movements between the cover and the chassis to couple or uncouple the cover from the chassis.

6 Claims, 11 Drawing Sheets

U.S. PATENT DOCUMENTS

| | | | | |
|---|---|---|---|---|
| 2005/0257574 | A1 | 11/2005 | Lyu | |
| 2006/0290247 | A1 | 12/2006 | Lim et al. | |
| 2008/0304937 | A1 | 12/2008 | Lim et al. | |
| 2010/0107937 | A1 | 5/2010 | Sandrin | |
| 2011/0121694 | A1* | 5/2011 | Kim et al. | 312/204 |

FOREIGN PATENT DOCUMENTS

| | | | |
|---|---|---|---|
| DE | 3739033 | A1 | 5/1989 |
| EP | 0096017 | A2 | 12/1983 |
| JP | 5123492 | A | 5/1993 |
| JP | 10118383 | A | 5/1998 |
| JP | 2000271382 | A | 10/2000 |
| KR | 20000046691 | A | 7/2000 |
| KR | 20020048575 | A | 6/2002 |
| KR | 20030013638 | A | 2/2003 |
| KR | 20050022091 | A | 3/2005 |
| KR | 20070066219 | A | 6/2007 |
| KR | 100784714 | B1 | 12/2007 |
| KR | 100854999 | B1 | 8/2008 |
| WO | 2005/124008 | A1 | 12/2005 |

* cited by examiner

APPLIANCE CABINET AND METHOD OF ASSEMBLING SAME

CROSS REFERENCE TO RELATED APPLICATIONS

The present application claims the benefit of U.S. Provisional Patent Application No. 61/323,667, filed Apr. 13, 2010, which is incorporated herein by reference in its entirety.

BACKGROUND OF THE INVENTION

Laundry treating appliances, such as a washing machine or a clothes dryer, may include an outer cabinet, including a chassis or lower housing and a cover or top panel coupled to the lower housing. A cycle of operation of the laundry treating appliance, such as during a load imbalance condition, may cause vibrations and/or displacement of the cabinet. Due to the vibration/displacement, the top panel may move relative to the lower housing and/or may become dislodged from the lower housing.

SUMMARY OF THE INVENTION

The invention relates to an appliance cabinet and a method for assembling the same, the cabinet having a chassis defining an open top, a cover removably mounted to the chassis to close the open top, and a coupler connecting the cover and the chassis. The coupler includes a first structural element on the chassis and a second structural element on the cover, wherein the first and second structural elements are physically configured to define a path requiring a specific sequence of relative movements between the cover and chassis to couple or uncouple the cover from the chassis.

DESCRIPTION OF EMBODIMENTS OF THE INVENTION

The present invention relates to a cabinet for an appliance, such as a laundry treating appliance. In particular, one embodiment of the invention relates to a cabinet structure having an improved coupling between a lower housing and a top panel on the lower housing.

Figure 1:
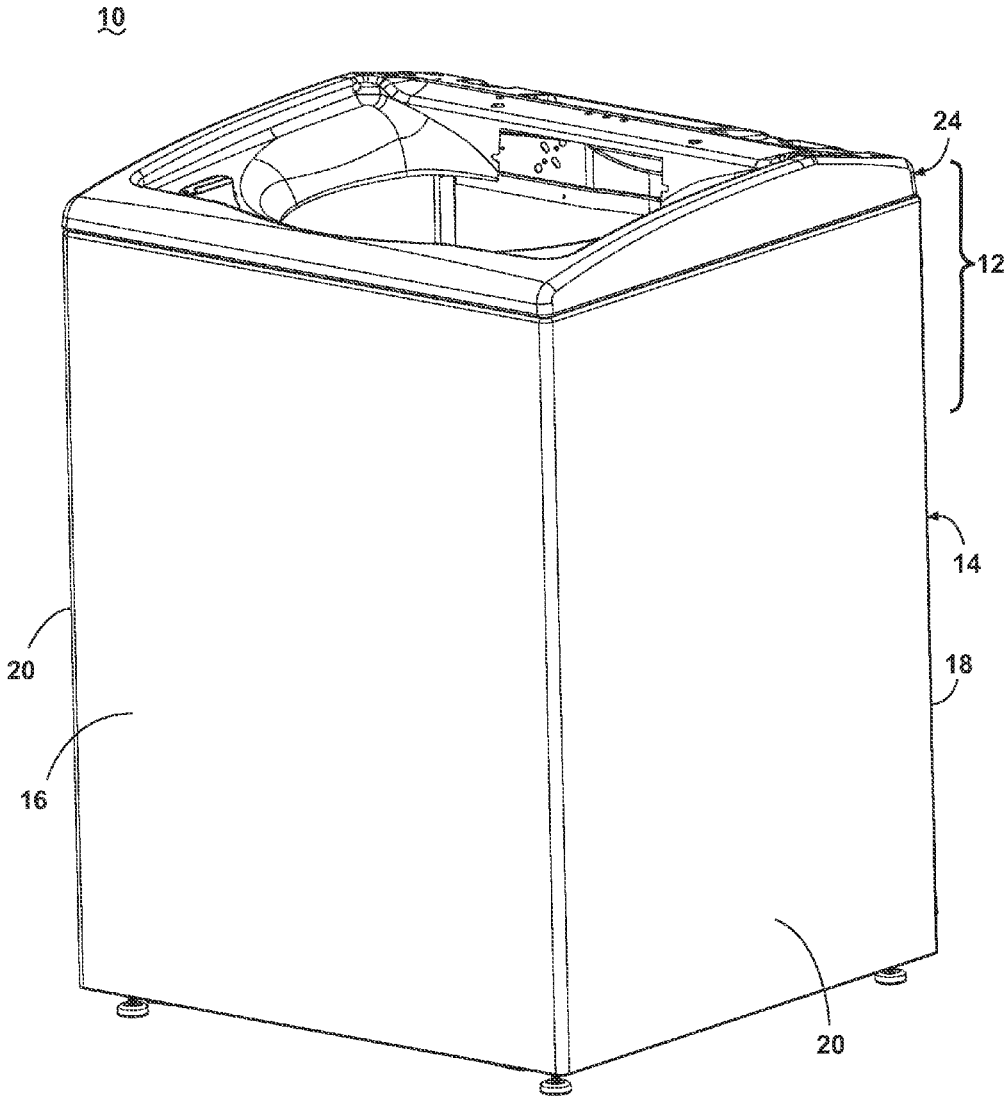
FIG. 1 is a perspective view of a laundry treating appliance having a cabinet in accordance with one embodiment of the invention, illustrating a lower housing and a top panel, with a lid for closing an opening in the top panel removed for clarity.

FIG. 1 illustrates one embodiment of a laundry treating appliance 10 having a cabinet 12 according to one embodiment of the invention. As illustrated, the laundry treating appliance is a vertical-axis washing machine; however, the laundry treating appliance 10 may be any appliance which includes a cabinet structure, non-limiting examples of which include a horizontal-axis washing machine; a horizontal or vertical axis clothes dryer; a combination washing machine and clothes dryer; a tumbling or stationary refreshing/revitalizing machine; an extractor; a non-aqueous washing apparatus; and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. The laundry treating appliance 10 described herein shares many features of a traditional automatic washing machine, which will not be described in detail except as necessary for a complete understanding of the invention. It is also understood that the cabinet 12 is applicable to appliances other than laundry treating appliances. For purposes of description related to the figures, the terms "upper," "lower," "right," "left," "rear," "front," "vertical," "horizontal," and derivatives thereof shall relate to the invention as oriented in FIG. 1 from the perspective behind the laundry treating appliance 10, which defines the rear of the laundry treating appliance 10.

As illustrated in FIG. 1, the cabinet 12 may include a chassis in the form of a lower housing 14 having a front panel 16, a rear panel 18, and a pair of side panels 20. The front, rear, and side panels 16, 18, 20 may each be formed as separate pieces, or may be formed as one or more continuous pieces. For example, the rear panel 18 may be separate, while the front and side panels 16, 20 may be continuous with each other. The panels 16-20 may be mounted to a frame (not shown). It is noted that the terms "chassis" and "lower housing" as used herein may include just a frame on which outer panels are attached, or the entire cabinet, with or without an underlying frame. A cover in the form of a top panel 24 may be supported on an upper portion of the lower housing 14, above the front, rear, and side panels 16, 18, 20. A lid (not shown for clarity) may be hingedly coupled to the top panel 24 for selectively closing an opening in the top panel 24 through which interior components of the laundry treating appliance, such as a drum and treating chamber, may be accessed.

The lower housing 14 and top panel 24 may include a coupling structure that prevents unintentional movement of the top panel 24 relative to the lower housing 14. Specifically, the coupling structure includes one or more structural elements on the lower housing 14 that interact with one or more cooperating structural elements on the top panel 24. The cooperating structural elements are physically configured to curb or obstruct movement by preventing the top panel 24 from being dislodged from the lower housing 14 during operation, even in an unbalanced load condition within the laundry treating appliance 10, unless the top panel 24 undergoes a specific sequence of movements along a path defined by the cooperating structural elements. The sequence of movements may be designed to be tortuous or labyrinthine, so that the top panel 24 must be deliberately moved through the sequence dictated by the coupling structure in order to remove the top panel 24 from the lower housing. As such, the coupling structure may be considered to be a labyrinth coupler. Throughout the sequence of movements, the first and second structural elements may selectively engage each other in different combinations; as used herein, the term "engage" and variations thereof includes any contact, abutment, or other interaction between the first and second structural elements.

Figure 2:
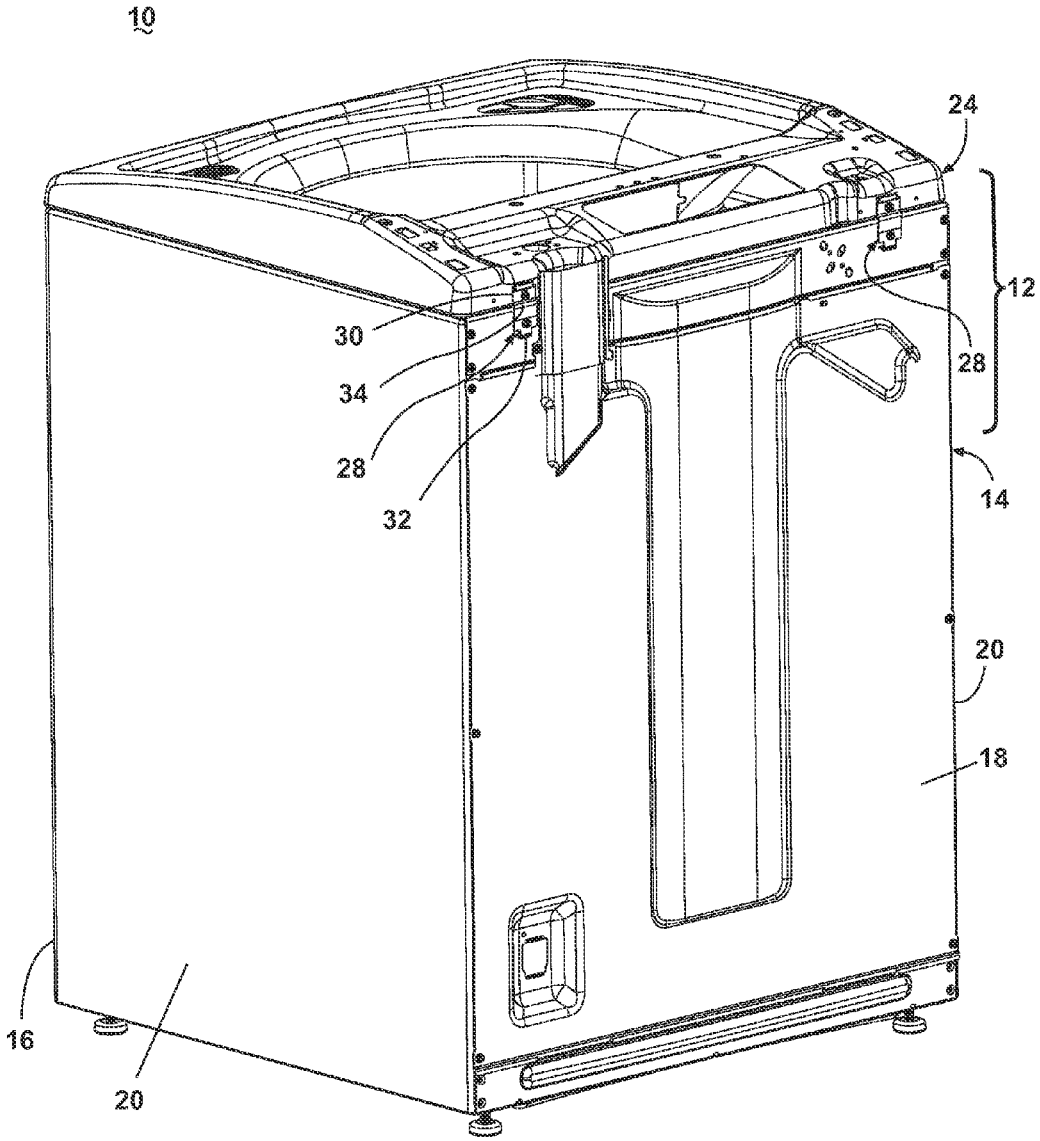
FIG. 2 is a rear view of the laundry treating appliance from FIG. 1, illustrating a hinge bracket coupling the lower housing and top panel.

FIG. 2 is a rear view of the laundry treating appliance 10 from FIG. 1. At least one hinge illustrated as a hinge bracket 28, which may form a portion of the coupling structure, couples the top panel 24 to the lower housing 14; as illustrated, the laundry treating appliance 10 includes two spaced hinge brackets 28. The hinge bracket 28 comprises a lower portion 30 coupled to the rear panel 18 of the lower housing 14 and an upper portion 32 coupled to the top panel 24 and joined to the lower portion 30 by a living hinge 34. The hinge bracket 28 permits the top panel 24 to move with respect to the lower housing 14, while still remaining attached to the lower housing 14.

Figure 3:
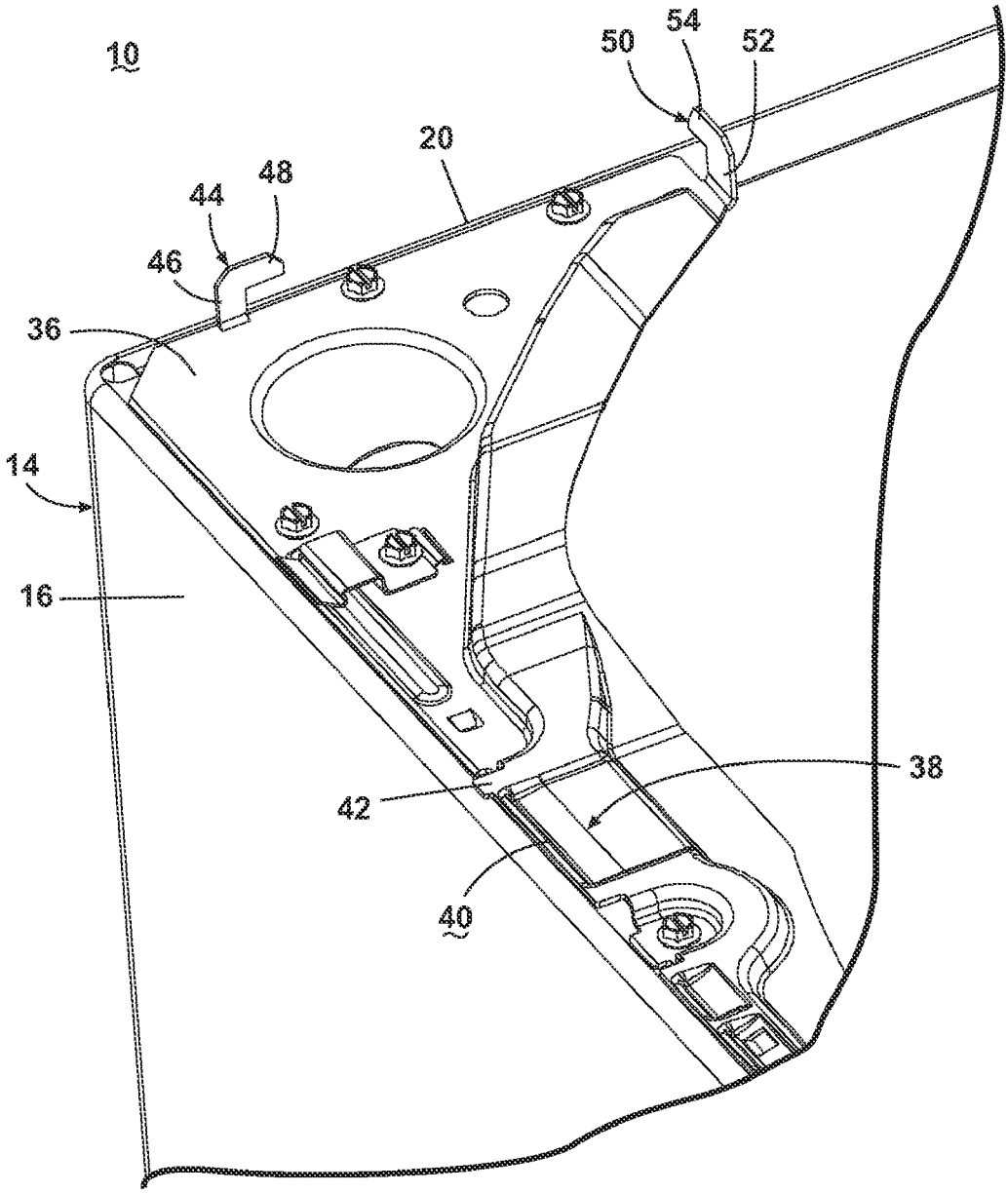
FIG. 3 is a perspective view of a portion of the laundry treating appliance from FIG. 1, with the top panel removed to show interior components, including a bracket.

FIG. 3 is a perspective view of a portion of the laundry treating appliance 10, with the top panel 24 removed to show interior components. A bracket 36, only a portion of which is visible in FIG. 1, may be coupled to the lower housing 14 along an upper front of the lower housing 14 and at least partially along the upper sides of the lower housing 14, such that the bracket 36 spans the corner junctions between the front panel 16 and the side panels 20. As illustrated, the bracket 36 may include multiple features related to the coupling structure. A first guide 38 may be provided along a front side of the bracket 36, and may include a recess 40 open to a front side of the lower housing 14 and a guide tab 42 adjacent the recess. A second guide 44 may be provided along a lateral side of the bracket 36, and may include a generally flat and L-shaped tab having an upwardly-projecting stem portion 46 and a rearwardly-projecting arm portion 48. A third guide 50 may be provided along a rear side of the bracket 36, and may be similar in shape to the second guide 48, but may be oriented perpendicularly to the second guide 48. The third guide 50 may include an upwardly-projecting stem portion 52 and a laterally-projecting arm portion 54.

The portion of the bracket 36 not shown is generally a minor image of the portion shown in FIG. 3, and has many of the same structural elements arranged for cooperative registry with the structural elements of the top panel 24 to provide support and movement-curbing functionality to the assembled cabinet 12. The bracket 36 may further be contoured, and configured with other embossments, openings, slots, depressions, rails, flanges and the like, for support of the bracket 36 on the lower housing 14 and the top panel 24 on the bracket 36.

While multiple guides are provided in the illustrated embodiment, fewer guides may be provided for the coupling structure. In an alternate embodiment, only one of the second or third guides 44, 50 may be provided in addition to the first guide 38. Further, while the features of coupling structure on the lower housing 14 are shown as being formed on the bracket 36, it is also within the scope of the invention for the features of the coupling structure on the lower housing 14 to be formed on any of the front, rear, and side panels 16, 18, 20 or the frame (not shown).

Figure 4:
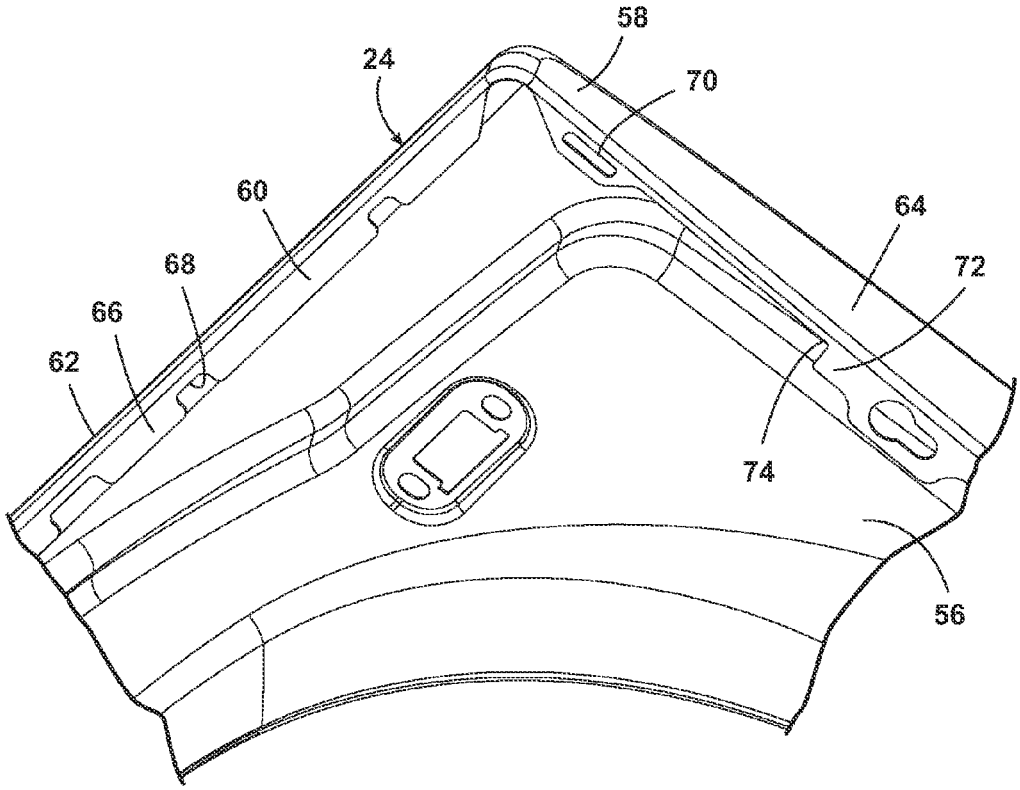
FIG. 4 is a bottom perspective view of a portion of the top panel from FIG. 1.

FIG. 4 is a bottom perspective view of a portion of the top panel 24. The top panel 24 includes an upper wall 56 connected to a peripheral side wall 58, and having an inwardly projecting bottom wall 60 connected to a lower end of the peripheral side wall 58. In the perspective shown in FIG. 4, a front side 62 and a lateral side 64 of the peripheral side wall 58 are visible. As illustrated, the bottom wall 60 includes multiple features related to the coupling structure. A front tab 66 may be formed in the bottom wall 60 along the front side 62 of the peripheral side wall 58 by a relief area 68, and may be generally horizontally-oriented and rearwardly-projecting. A slot 70 may be formed in the bottom wall 60 adjacent the lateral side 64 of the peripheral side wall 58, and may be an elongated enclosed opening formed in the bottom wall 60. A lateral tab 72 may be formed in the bottom wall 60 along the lateral side 64 of the peripheral side wall 58 by a recess forming a relief area 74, and may be generally horizontally-oriented and inwardly-projecting.

The portion of the top panel 24 not shown is generally a minor image of the portion shown in FIG. 4, and has many of the same structural elements arranged for cooperative registry with the structural elements of the bracket 36 to provide support and movement-curbing functionality to the assembled cabinet 12. The top panel 24 may further be contoured, and configured with embossments, openings, slots, depressions, rails, flanges, and the like, for support of the top panel 24 on the lower housing 14 and bracket 36.

FIGS. 5A-6E illustrate the relative position of the coupling structure during movement of the top panel 24 along the path dictated by the coupling structure in order to at least partially uncouple the top panel 24 from the lower housing 14. In general, the specific sequence of relative movements between the top panel 24 and lower housing 14 to couple or uncouple the top panel 24 from the lower housing 14 includes a first linear movement along a first axis, a second linear movement along a second axis that is non-coaxial with the first axis, and a third movement interposed between the first and second movements along a third axis that intersects the first and second axes. As such, the third movement is a shifting-type movement. Optionally, the sequence can include a fourth movement along a fourth axis after the second linear movement.

More specifically, as illustrated herein, the sequence of movements to remove the top panel 24 include, with respect to the lower housing 14, moving the top panel laterally forward (corresponding to the first linear movement), lifting at least the front portion of the top panel 24 upwardly a first time (corresponding to the third movement), moving the top panel laterally rearwardly (corresponding to the second linear movement), and lifting at least the front portion of the top panel 24 upwardly a second time (corresponding to the fourth movement). Throughout the sequence of movements, the top panel 24 may remain at least partially coupled to the lower housing 14 by the hinge brackets 28. In this sequence, the first and second linear movements are opposing and are vertically offset. Further, the first and second linear movements may be sliding-type movements. The third and fourth movements may be pivoting movements due to the hinge brackets 28, and may have both a vertical component and a horizontal component.

Figure 5A:
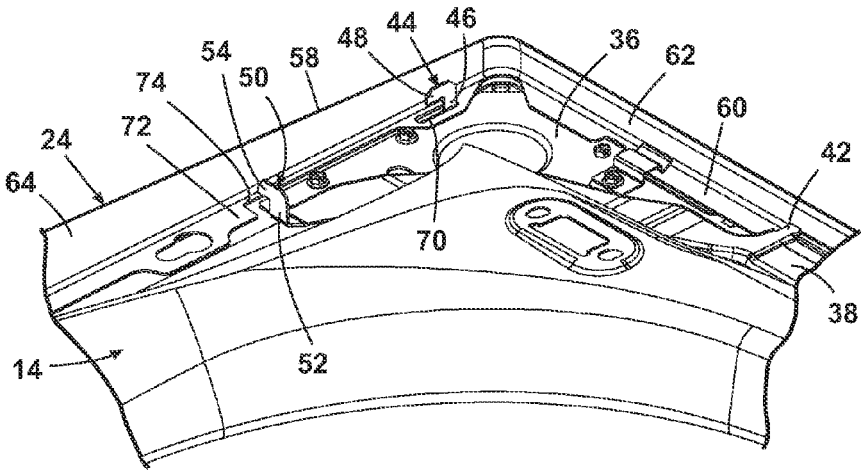
FIGS. 5A-5E are enlarged views of a front portion of the laundry treating appliance sectioned through the top panel from FIG. 1, illustrating the position of the top panel relative to the lower housing during movement of the top panel 24 from a fully coupled position to a partially uncoupled position.

FIG. 5A shows the front portion of the coupling structure with the top panel 24 in a fully coupled position. As illustrated, in the fully coupled position, the top panel 24 may be generally aligned with the lower housing 14. The front tab 66

(not visible) cooperates with the recess 40 of the first guide 38, such that the front tab 66 may be at least partially received within the recess 40 and the guide tab 42 overlies the bottom wall 60. The second guide 44 cooperates with the slot 70, such that the stem portion 46 projects through the slot 70. The third guide 50 cooperates with the lateral tab 72, such that the arm portion 54 projects over the relief area 74. The front tab 66 within the first guide 38 limits the rearward movement of the top panel 24 with respect to the lower housing 14.

Figure 5B:
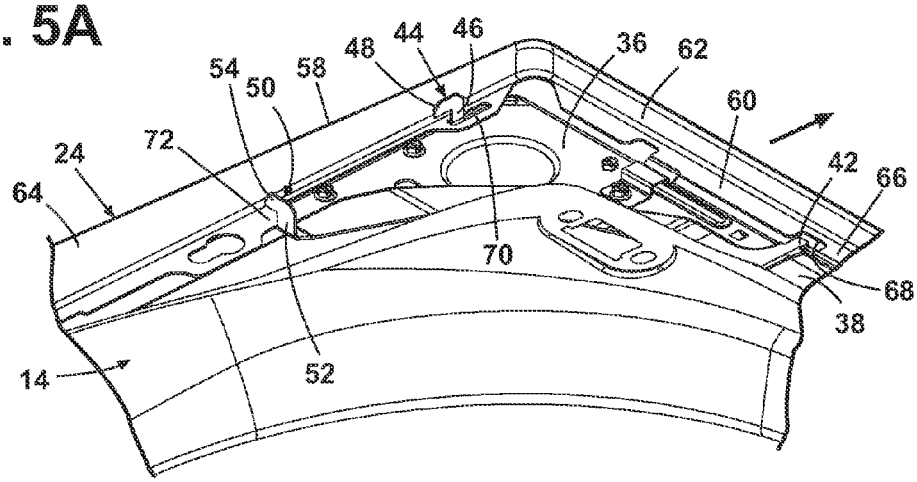

FIG. 5B shows the front portion of the coupling structure with the top panel 24 in a first intermediate position. As illustrated, in the first intermediate position, the top panel 24 may be translated laterally in a forward direction with respect to the lower housing 14. The second guide 44 remains in the slot 70, with the stem portion 46 moved forwardly in the slot 70 and the arm portion 48 now overlying the bottom wall 60. The stem portion 52 of the third guide 50 is also translated forward, with the arm portion 54 projecting over the lateral tab 72. The front tab 66 may be removed from the recess 40 of the first guide 38 and the guide tab 42 does not overly the bottom wall 60 of the top panel 24. To move from the coupled position shown in FIG. 5A to the first intermediate position, the top panel 24 may be pulled or otherwise moved in a forward direction. Movement to the first intermediate position may also include some upward movement, i.e. a vertical component. The second guide 44 within the slot 70 limits the forward movement of the top panel 24.

Figure 5C:
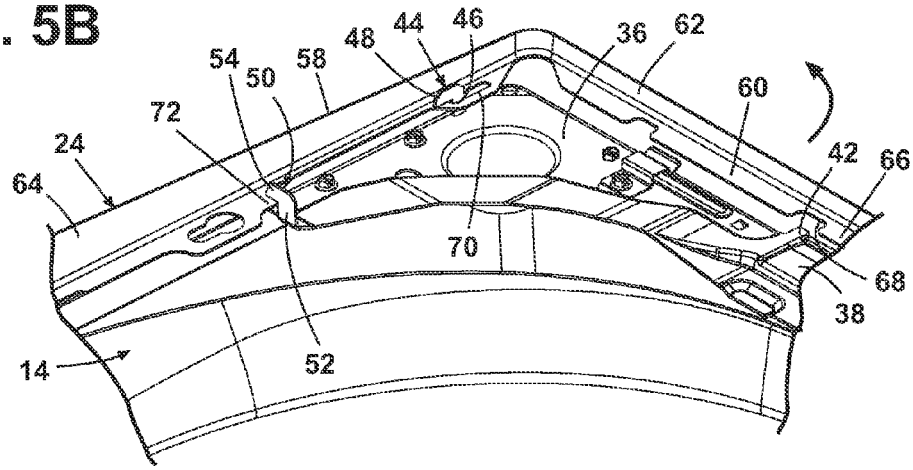

FIG. 5C shows the front portion of the coupling structure with the top panel 24 in a second intermediate position. As illustrated, in the second intermediate position, at least the front portion of the top panel 24 may be translated vertically in an upward direction with respect to the lower housing 14. The front tab 66 may be cleared from the recess 40 of the first guide 38 and the guide tab 42 may be cleared from the bottom wall 60 of the top panel 24, such that the first guide 38 is no longer coupled to the top panel 24. The arm portions 48, 54 of the second and third guides 44, 50 remain overlying the bottom wall 60, but now abut the bottom wall 60. To move from the first intermediate position shown in FIG. 5B to the second intermediate position, at least the front portion of the top panel 24 may be lifted or otherwise moved in an upward direction. The second and third guides 44, 50 abutting the bottom wall 60 limit the upward movement of the top panel 24.

Figure 5D:
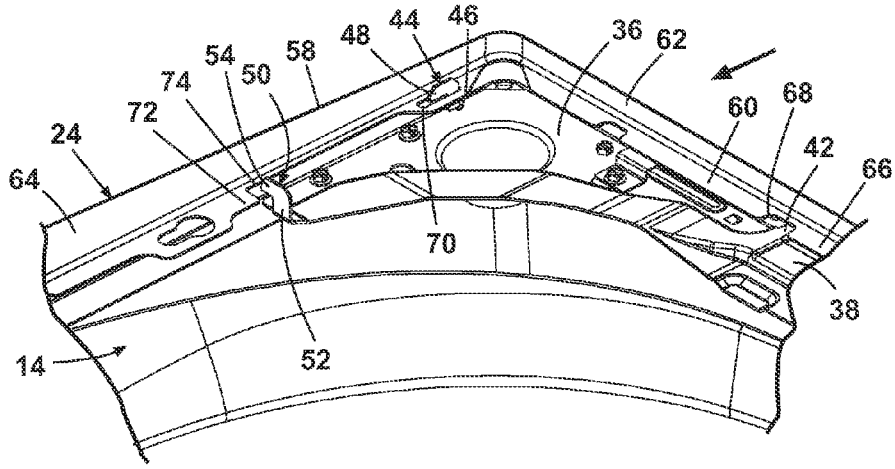

FIG. 5D shows the front portion of the coupling structure with the top panel 24 in a third intermediate position. As illustrated, in the third intermediate position, the top panel 24 may be translated laterally in a rearward direction with respect to the lower housing 14. The top panel 24 remains uncoupled from the first guide 38. The second guide 44 remains in the slot 70, but the arm portion 48 projects over the slot 70 and not over the bottom wall 60 of the top panel 24. The arm portion 54 of the third guide 50 projects over the relief area 74. To move from the second intermediate position shown in FIG. 5C to the third intermediate position, the top panel 24 may be pushed or otherwise moved in a rearward direction. Movement to the third intermediate position may also include some downward movement, which would include a vertical component. The second guide 44 within the slot 70 limits the rearward movement of the top panel 24.

Figure 5E:
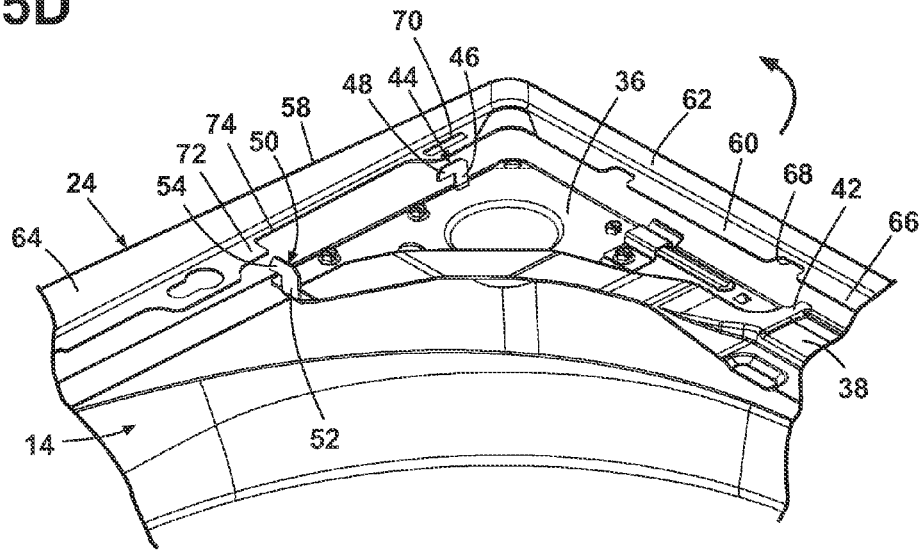

FIG. 5E shows the front portion of the coupling structure in a partially uncoupled position. As illustrated, in the partially uncoupled position, at least the front portion of the top panel 24 may be translated vertically in an upward direction with respect to the lower housing 14. The top panel 24 may be uncoupled from all three guides 38, 44, 50. To move from the third intermediate position shown in FIG. 5E to the partially uncoupled position, at least the front portion of the top panel 24 may be lifted or otherwise moved in an upward direction. While not visible in FIG. 5E, the top panel 24 remains coupled to the lower panel 14 by the hinge brackets 28.

Figure 6A:
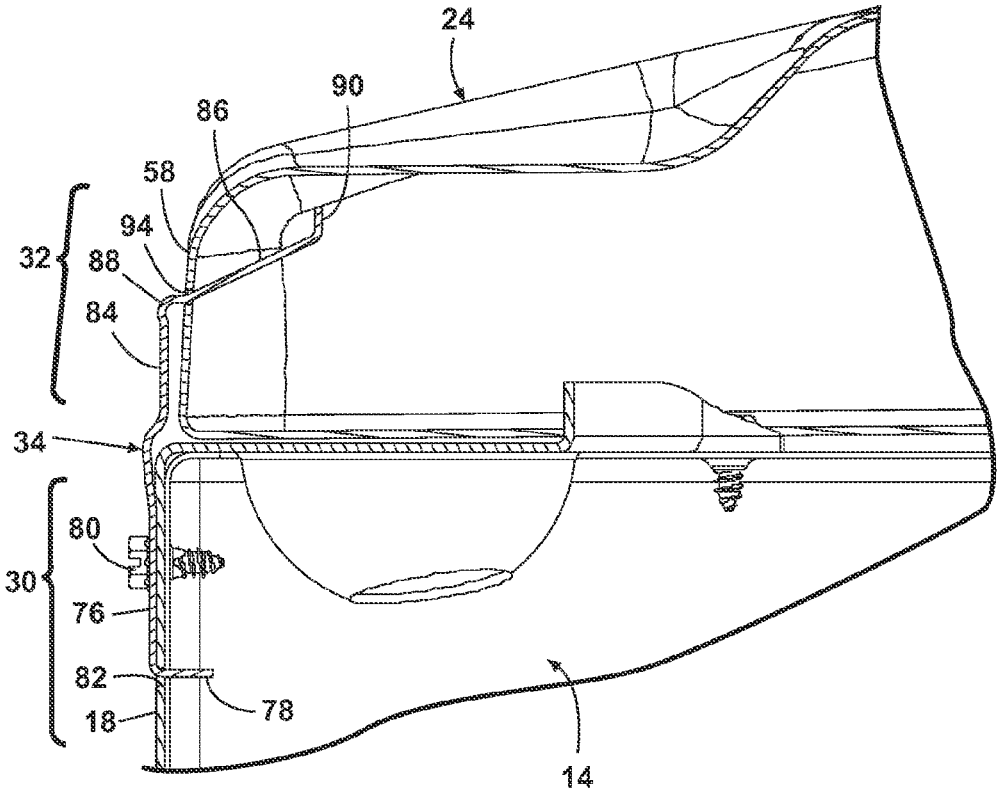
FIGS. 6A-6E are enlarged views of a rear portion of the laundry treating appliance sectioned through the hinge bracket from FIG. 2, illustrating the position of the top panel relative to the lower housing during movement of the top panel 24 from a fully coupled position to a partially uncoupled position.

FIG. 6A shows the rear portion of the coupling structure with the top panel 24 in a fully coupled position. As illustrated, in the fully coupled position, the top panel 24 may be generally aligned with the lower housing 14 and the hinge bracket 28 may attach the top panel 24 to the lower housing 14. The lower portion 30 of the hinge bracket 28 comprises a generally flat hinge plate 76 having a flange 78 at a lower end thereof. The lower portion 30 may be fixedly coupled to the rear panel 18 of the lower housing 14 by a first fastener 80, with a slot 82 in the rear panel 18 receiving the flange 78 and the hinge plate 76 adjacent the rear panel 18. The upper portion 32 also comprises a generally flat hinge plate 84 having an angled portion 86 joined to the upper end of the hinge plate 84 by a curved portion 88. A stop 90 may be provided near the terminal end of the angled portion 86. The upper portion 32 may be coupled to the top panel 24 by a second fastener (not shown), with a slot 94 in the peripheral side wall 58 of the top panel 24 receiving the angled portion 86.

Figure 6B:
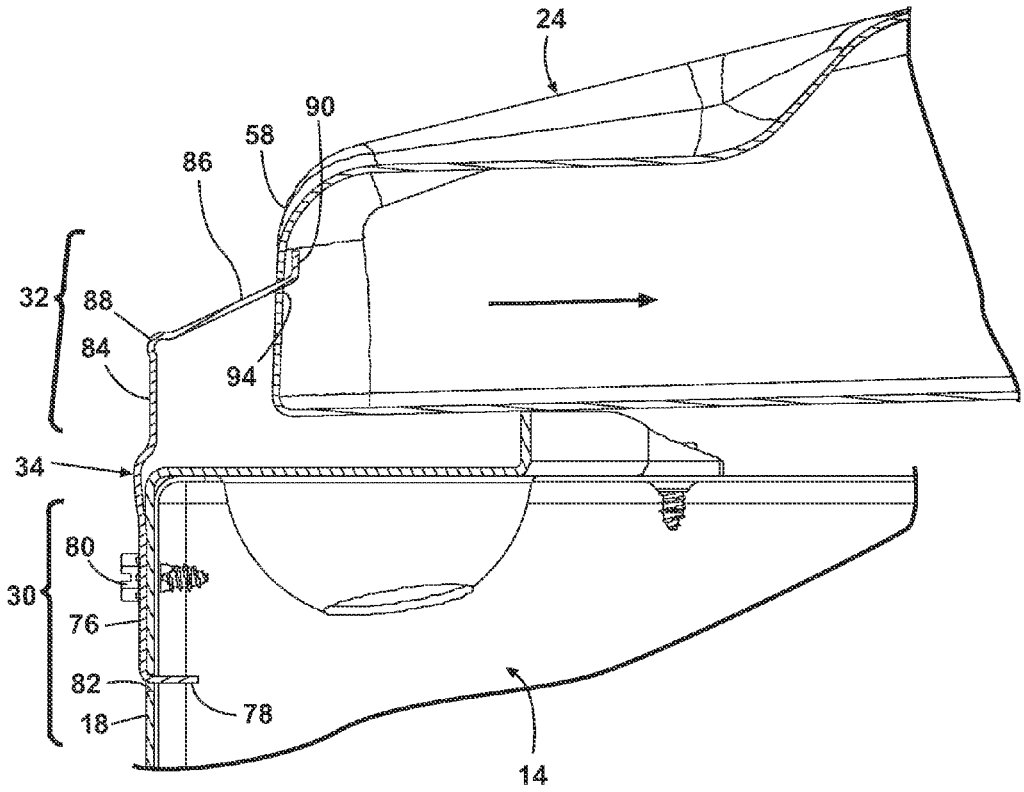

FIG. 6B shows the rear portion of the coupling structure with the top panel 24 in the first intermediate position. As illustrated, in the first intermediate position, the top panel 24 may be translated laterally in a forward direction with respect to the hinge bracket 28. Movement to the first intermediate position may also include some upward movement, which would include a vertical component. The angled portion 86 guides the movement of the top panel 24. The stop 90 may limit the forward movement of the top panel 24 with respect to the hinge bracket 28.

Figure 6C:
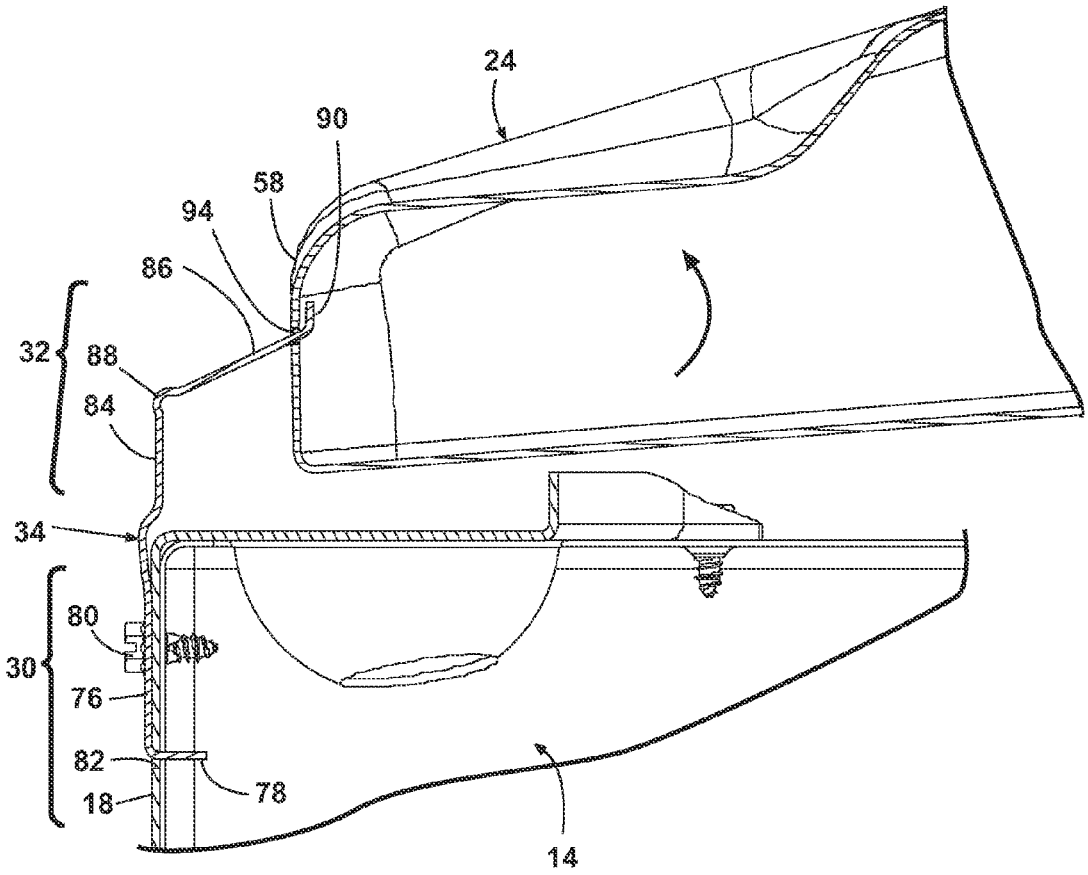

FIG. 6C shows the rear portion of the coupling structure with the top panel 24 in the second intermediate position. As illustrated, in the second intermediate position, the top panel 24 may be pivoted in an upward direction with respect to the hinge bracket 28.

Figure 6D:
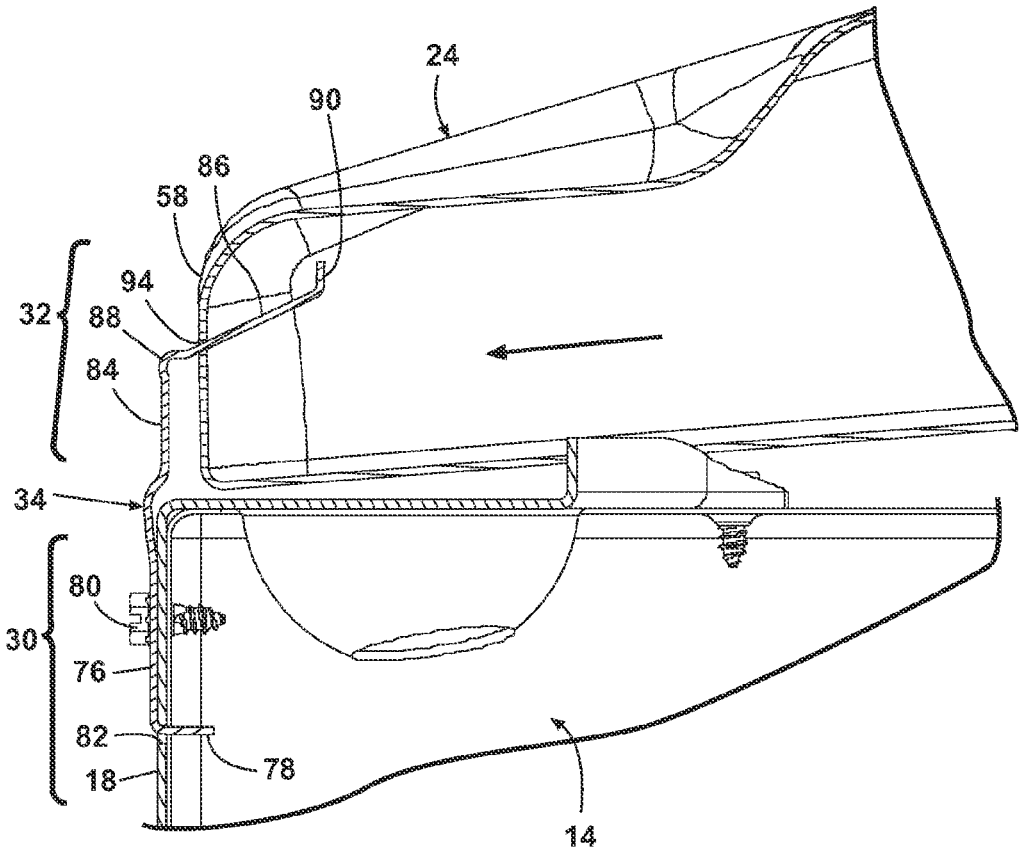

FIG. 6D shows the rear portion of the coupling structure with the top panel 24 in the third intermediate position. As illustrated, in the third intermediate position, the top panel 24 may be translated laterally in a rearward direction with respect to the hinge bracket 28. Movement to the third intermediate position may also include some downward movement, which would include a vertical component. The angled portion 86 guides the movement of the top panel 24.

Figure 6E:
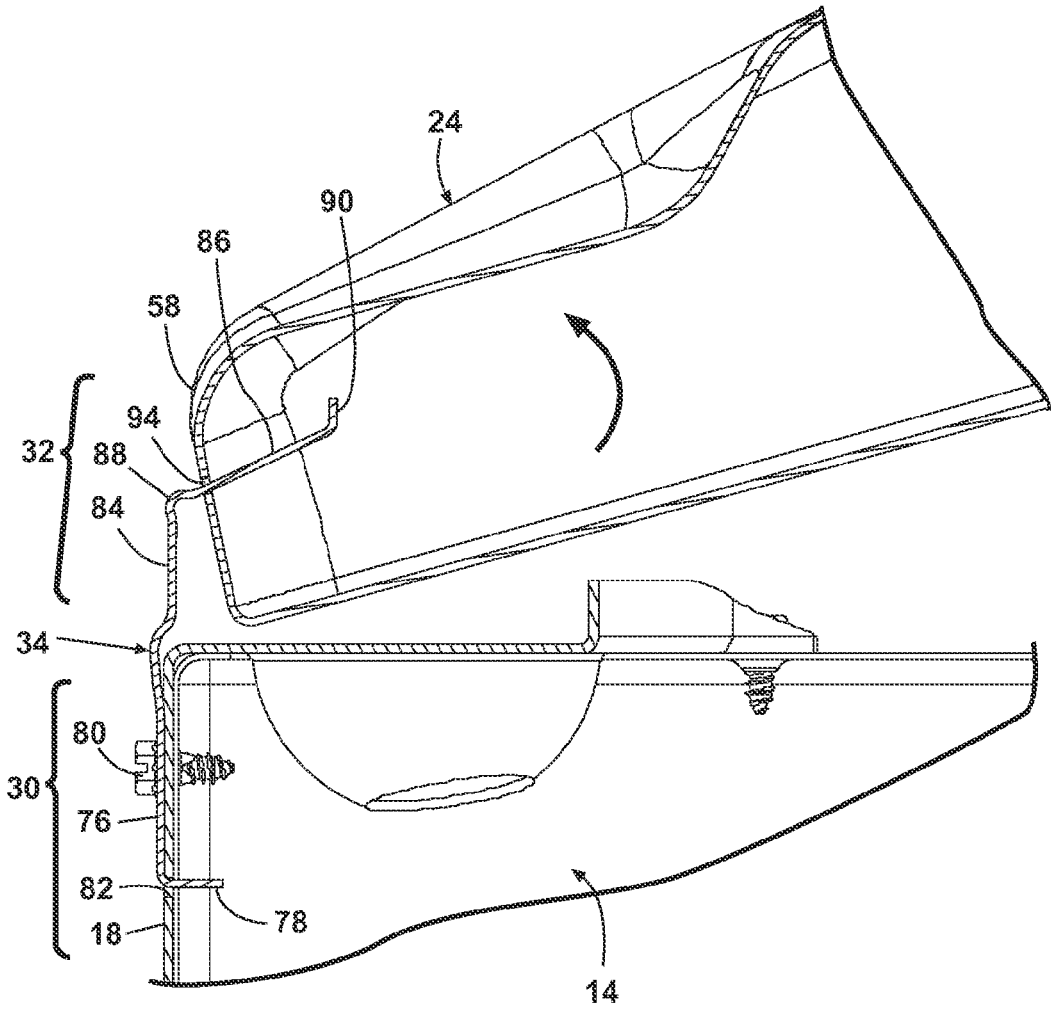

FIG. 6E shows the rear portion of the coupling structure in the partially uncoupled position. As illustrated, in the partially uncoupled position, the top panel 24 may be pivoted in an upward direction with respect to the hinge bracket 28 to a greater angle than for the second or third intermediate positions.

While FIGS. 5A-6E illustrate the relative position of the coupling structure during movement of the top panel 24 along the path dictated by the coupling structure in order to at least partially uncouple the top panel 24 from the lower housing 14, it is understood that the same sequence of movements in reverse will serve as a method to assemble the top panel 24 and the lower housing 14.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of assembling an appliance cabinet having a chassis defining an open top, a cover removably mounted to the chassis to close the open top, and a coupler having a first structural element on the chassis and a second structural element on the cover, wherein the cover comprises front and rear opposing sides and the chassis comprises front and rear opposing sides, the method comprising:

A) moving the cover relative to the chassis in a first linear direction along a first axis to position the first and second structural elements in a first engaged position;

B) moving the cover relative to the chassis in a second linear direction that is non-coaxial with the first axis to position the first and second structural elements in a second engaged position, different from the first engaged position; and C) moving the cover relative to the chassis in a third direction along a third axis that intersects both the first and second axes to position the first and second structural elements in a third engaged position, different from the first and second engaged positions;

wherein the movement according to step (C) is interposed between the movements according to steps (A) and (B); and wherein the movements according to steps (A) and (B) comprise sliding the cover relative to the chassis; and further comprising pivotally attaching a rear side of the cover to a rear side of the chassis prior to the movement according to step (A).

2. The method of claim 1 wherein step (C) comprises pivoting the cover relative to the chassis.

3. The method of claim 1 wherein step (C) comprises lowering the cover toward the open top.

4. The method of claim 1 wherein the chassis comprises front and rear opposing sides and the sliding the cover in step (A) comprises sliding the cover in one of a front-to-rear and rear-to-front direction, and the sliding the cover in step (B) comprises sliding the cover in the other of the front-to-rear and rear-to-front directions.

5. The method of claim 1, further comprising lowering a front side of the cover toward the open top prior to step (A).

6. The method of claim 1 wherein the first and second linear directions are opposing.

* * * * *